United States Patent [19]

Membrino

[11] 4,406,371

[45] * Sep. 27, 1983

[54] SELF-CONTAINED PAD OF PLASTIC BAGS

[76] Inventor: Hercules Membrino, 280 Paoli State Rd., Malvern, Pa. 19355

[ * ] Notice: The portion of the term of this patent subsequent to Dec. 15, 1998 has been disclaimed.

[21] Appl. No.: 319,639

[22] Filed: Nov. 9, 1981

Related U.S. Application Data

[63] Continuation-in-part of Ser. No. 143,318, Apr. 24, 1980, Pat. No. 4,305,503.

[51] Int. Cl.[3] ..... B65D 85/62; B65D 30/00

[52] U.S. Cl. ..... 206/554; 206/526

[58] Field of Search ..... 206/554, 526

[56] References Cited

U.S. PATENT DOCUMENTS

| | | | |
|---|---|---|---|
| 1,170,590 | 2/1916 | Wheeler | 206/389 |
| 2,780,352 | 2/1957 | Schroeder | 206/389 |
| 3,021,947 | 2/1962 | Sylvester et al. | 206/554 |
| 3,312,339 | 4/1967 | Million | 206/526 |
| 3,353,661 | 11/1967 | Membrino | 206/554 |
| 4,305,503 | 12/1981 | Membrino | 206/554 |

FOREIGN PATENT DOCUMENTS

| | | | |
|---|---|---|---|
| 7440652 | 10/1972 | France | 206/554 |
| 294201 | 4/1965 | Netherlands | 206/554 |
| 7016888 | 5/1971 | Netherlands | 206/526 |
| 1037295 | 7/1966 | United Kingdom | 206/389 |

*Primary Examiner*—William T. Dixson, Jr.
*Assistant Examiner*—Brenda J. Ehrhardt
*Attorney, Agent, or Firm*—Arthur A. Jacobs

[57] ABSTRACT

A pad of plastic units comprising a plurality of bag pockets overlying each other in layers, each pocket having an open mouth and an extension of its rear wall, there being a score line in the extension defining the edge of the rear wall of the bag when the bag is severed from the pad. The extensions of all the pockets being secured together to form a base portion for the pad, and welds or similar connections at the side of the base portion which form side anchors to provide a counter-force when a forward pull is exerted at the mouth of an individual pocket, whereby the bag is completely opened simultaneously with its being severed from the pad, and a handle constituted by a slit or similar device in the base portion to permit entry of the fingers of a hand or any other desired support means which will act to support the pad while an individual bag is severed therefrom.

5 Claims, 3 Drawing Figures

FIG. 1
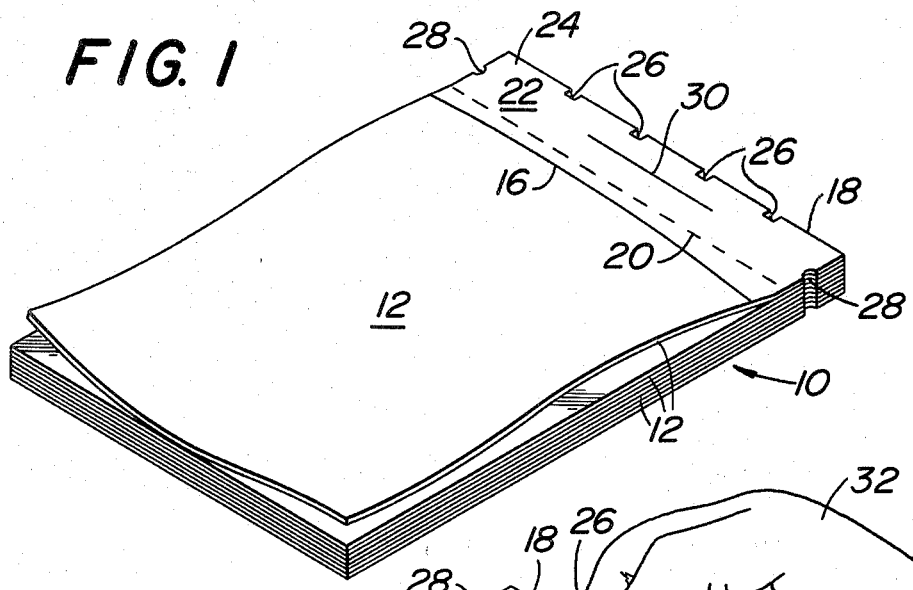
FIG. 2
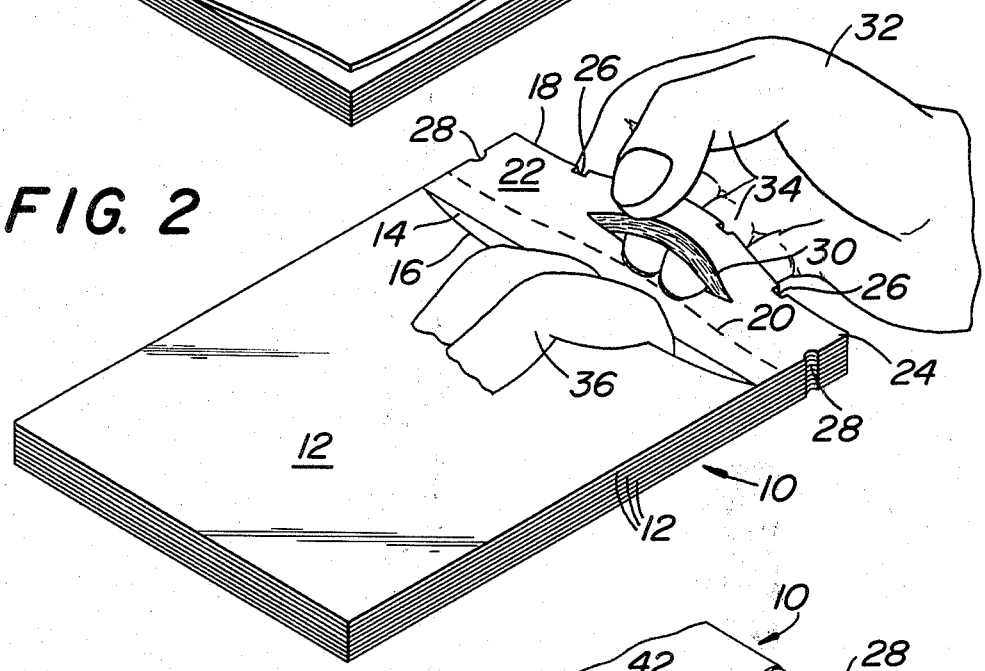
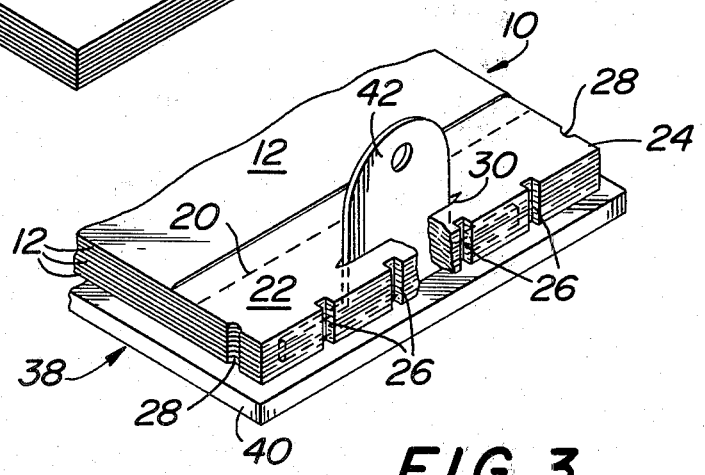
FIG. 3

SELF-CONTAINED PAD OF PLASTIC BAGS

This application is a continuation-in-part of Application Ser. No. 143,318, filed Apr. 24, 1980, and now issued as U.S. Pat. No. 4,305,503, dated Dec. 15, 1981.

This invention relates to plastic bags, and it particularly relates to packs or pads comprising a plurality of plastic bags connected to each other in such a manner that the pad may be easily supported by hand or by any other desired support means while individual bags are removed as desired.

The bag pads disclosed in the aforesaid patent Application Ser. No. 143,318, now U.S. Pat. No. 4,305,503 comprise layers of bag units, each of which consists of a pair of open-mouthed pockets integrally connected to each other by a common spacer portion positioned between the open mouths.

A pair of spaced parallel score lines extend from end to end of the spacer portion. Each score line is in spaced relation to the edge defining the open end of the respective pocket, whereby each such edge constitutes a lip which may be grasped and pulled forward. When so pulled, the individual bag is torn away at the respective score line, leaving the remainder of the pad intact.

At each end of the spacer portion, between the score lines, is provided a common weld for all of the bag units in the pad. These welds form anchor means whereby, when a bag is torn away from the pad, the mouth becomes fully opened by the pulling action because of the counterforce exerted at each side by the welds. This counterforce is especially important when the bags are made of thermoplastic material where the front and rear walls of the bags are highly adherent to each other.

It has now been found that the same general concept is utilizable with single bag pads, that is, pads which comprise layers of individual plastic bags rather than the double pocket units consisting of two pockets connected by a spacer portion. An advantage of using this concept with single bags is that such single bag pads are easily adaptable to be held in the hand while severing individual bags, thereby making it highly portable and available at any time. However, these pads may also be used on any feasible type of fixed support, if so desired.

It is, therefore, an object of the present invention to provide self-contained pads of plastic bags which are adapted to be used either while held in the hand or on a fixed support.

It is another object of the present invention to provide pads of bags of the aforesaid type which permit full opening of the individual bags by the simple motion of tearing them away from the pad.

Another object of the present invention is to provide pads of bags of the aforesaid type which are simple in construction and inexpensive to produce.

Other objects and many of the attendant advantages of this invention will be readily appreciated as the same becomes better understood by reference to the following description when read in conjunction with the accompanying drawings therein:

FIG. 1 is a front perspective view of a pad of bags embodying the present invention.

FIG. 2 is a front perspective view showing the pad of bags of FIG. 1 held in one hand while pulling a bag away with the fingers of the other hand.

FIG. 3 is a partial perspective view, partly broken away, showing the pad of bags of FIG. 1 mounted on a fixed support.

Referring now in greater detail to the various figures of the drawing wherein similar reference characters refer to similar parts, there is shown a pad, generally designated 10, comprising a series of plastic bag pockets 12. Each pocket 12 has an open mouth 14 defined at its front by a free edge 16 forming the upper edge of the front wall of the pocket—which becomes a bag when separated from the pad. The rear wall of the pocket extends beyond the edge 16 of the front wall and has an upper edge 18. A score line 20 extends from edge to edge of the extending portion of the rear wall and defines the upper edge of the rear wall of the bag after it is torn away from the pad.

The portion of the rear wall extending beyond the score line constitutes an extension or selvage portion 22. When the individual bag pockets are placed in overlying layered arrangement, as shown 1 in the drawing, their overlying extensions are integrally connected, as, for example, by one or more end welds 26 and by side welds 28. These welds form a solid connection between the layered extensions, which thereby form a base portion for the pad. Although these welds are preferably used, it is possible to substitute other integrating or connecting means such as clips, staples, adhesive, or the like.

The base portion 24 is provided with an elongated slit 30, which may be used as a handle or grasping means, the latter term being used to include not only a handle which may be grasped by the hand but also something which may be grasped by a device forming part of a fixed support or any other mechanical means, such as for example, shown in FIG. 3.

The slit is shown in use in FIG. 2 where the pad is held in the palm of the hand 32, with one or more fingers 34 extending through the slit. While being held in this manner, one or more fingers 36 of the other hand are inserted into the mouth 14 and the front wall of the pocket is pulled forwardly. The side welds 28 resist this forward pull, thereby causing the front wall to pull completely away from the rear wall; this causes the pocket to open completely at the same time it is being severed from the pad to form a bag.

FIG. 3 illustrates the pad 10 mounted on a fixed support, generally designated 38, comprising a bed 40 having an upstanding lug 42. The pad is mounted on the support 38 by laying it flat on the bed 40 and inserting the lug 42 through the slit 30.

Although one particular type of support means is illustrated in FIG. 3, this is merely for exemplification and any other desirable support means may be substituted.

It is, further, to be understood that although an elongated slit 30 is illustrated as one form of grasping means, and although such slit is preferable, any other feasible and desirable means may be substituted. For example, a plurality of smaller slits may be used, or the slit or slits may extend only partially through the base portion rather than entirely through it, or, instead of slits, one or more holes may be bored through the base portion. Such holes could be of dimensions that could accommodate the finger or fingers of a person's hand or the pins, lugs, hooks, or the like, of a fixed support. Or upstanding pins, lugs, knobs, or the like may be used instead of slits or holes.

In all instances, however, the slit or any of the other grasping means would be positioned in the base portion formed by the extensions 22 and would, therefore, have no effect on the construction or use of the bags when they are separated from the pad.

As indicated above, it is within the scope of the present invention to substitute clips, staples, adhesives, etc. for the preferable welds specifically shown at 26 and 28. When welds are used, it is preferable to use edge-type welds such as shown at 26 and 28, but other types of welds, such as the plug-type, may be substituted or used in addition to the edge-type welds if so desired.

The score line 20 is shown as consisting of a series of linearly arranged slits and hand portions or "nips". The nips are the connecting means holding the pocket to the pad. Although the score line 20 preferably consists of a plurality of slits and nips, as shown, it is possible, within the scope of the invention, to provide an elongated slit with only one nip holding the parts together. The term "score line", as used herein, is applicable to either type.

The invention claimed is:

1. A plastic bag pad comprising a plurality of plastic pockets, each pocket having a front wall and a rear wall, both said walls being integrally connected to each other except at their upper edges, the upper edges of said front and rear walls being free with the upper edge of said rear wall extending beyond the upper edge of said front wall, whereby the upper edge of said front wall forms a lip and whereby the portion of said rear wall extending beyond the upper edge of said front wall constitutes an extension, a score line extending from one side to the other side of said extension in spaced parallel relation to both the upper edge of said front wall and the upper edge of said rear wall to form a line of severance between said edges, the extensions of all the pockets in the pad being bound to each other above said score line by connecting means to form a base portion for said pad, said base portion having a free upper edge corresponding to the free upper edges of the individual pockets in the pad, at least a portion of said connecting means comprising side connections at opposite sides of said base portion, said base portion including grasping means whereby individual pockets may be separated from the pad to form an individual bag by supporting said pad at said grasping means while pulling said lip forwardly from said pad to break said score line, said lip and the edge formed by said broken score line forming a mouth for the bag, and said side connections having sufficient strength to avoid being broken during breaking of said score line and to thereby form anchor means to provide a counterforce to the forward pulling force on said lip whereby they aid in opening of the bag during exertion of said pulling force.

2. The bag pad of claim 1 wherein said side connections are welds at the respective side edges of said base portion.

3. The pad of claim 1 wherein at least one weld is provided at said upper edge of the base portion.

4. The pad of claim 1 wherein said grasping means comprises an opening in said base portion.

5. The pad of claim 4 wherein said opening comprises at least one slit spaced from and parallel to said score line.

* * * * *